United States Patent [19]

Watanabe

[11] Patent Number: 4,884,107

[45] Date of Patent: Nov. 28, 1989

[54] IMAGE FORMING APPARATUS FOR BLANKING PORTIONS OF A DOCUMENT

[75] Inventor: Junji Watanabe, Yokohama, Japan

[73] Assignee: Kabushiki Kaisha Toshiba, Kawasaki, Japan

[21] Appl. No.: 344,462

[22] Filed: Apr. 28, 1989

Related U.S. Application Data

[63] Continuation of Ser. No. 885,710, Jul. 15, 1986, abandoned.

[30] Foreign Application Priority Data

Aug. 12, 1985 [JP] Japan ..... 60-177201

[51] Int. Cl.[4] ..... G03G 21/00

[52] U.S. Cl. ..... 355/218; 346/153.1; 355/202; 358/300

[58] Field of Search ..... 355/200, 202, 218, 1; 358/300; 346/153.1, 160

[56] References Cited

U.S. PATENT DOCUMENTS

| | | | |
|---|---|---|---|
| 4,046,471 | 9/1977 | Branham et al. | 355/3 R X |
| 4,215,929 | 8/1980 | Sato et al. | 355/7 |
| 4,256,400 | 3/1981 | Komori et al. | 355/7 X |
| 4,319,741 | 3/1982 | Okamoto | 271/118 |
| 4,417,805 | 11/1983 | Kishi | 355/7 X |
| 4,435,077 | 3/1984 | Suzuki et al. | 355/7 X |
| 4,582,417 | 4/1986 | Yagasaki et al. | 355/7 |
| 4,611,906 | 9/1986 | Iwaki | 355/7 X |
| 4,616,269 | 10/1986 | Mori | 355/7 X |
| 4,627,707 | 12/1986 | Tani et al. | 355/7 X |
| 4,640,601 | 2/1987 | Deguchi et al. | 355/7 X |
| 4,655,580 | 4/1987 | Watanabe et al. | 355/7 |
| 4,707,109 | 11/1987 | Kanno et al. | 355/7 |

FOREIGN PATENT DOCUMENTS

| | | | |
|---|---|---|---|
| 0098509 | 1/1984 | European Pat. Off. . | |
| 57-204066 | 12/1982 | Japan . | |
| 59-88754 | 5/1984 | Japan | 355/14 R |
| 62-35337 | 2/1987 | Japan . | |
| 62-51870 | 2/1987 | Japan . | |
| 1416062 | 12/1975 | United Kingdom . | |
| 1487793 | 10/1977 | United Kingdom . | |

*Primary Examiner*—Fred L. Braun

*Attorney, Agent, or Firm*—Cushman, Darby & Cushman

[57] ABSTRACT

An image forming apparatus having an image carrier, a document table on which a document is placed, and a document feeder associated with the document table for feeding and document onto the document table, the document feeder including a document carrier for carrying the document and a designating unit for designating an image blanking range of the document placed on the document carrier. The image forming apparatus also includes an optical scanning unit for optically scanning the document fed onto the document table from the document feeder and for forming a reflected light image thereof, a first image forming unit for forming an electrostatic latent image corresponding to the light image onto the image carrier, a second image forming unit for producing a visible image on an image forming medium corresponding to the electrostatic latent image, an image blanking unit for selectively blanking a selected portion corresponding to the image blanking range designated by the designating unit of the electrostatic latent image formed by the first image forming unit, and a controller for controlling the image blanking unit to erase the electrostatic latent image corresponding to the blanking range. The apparatus permits images to be formed by designation of portions of the document for which an image is to be formed and blanks unnecessary portions, the designation being carried out on the document feeder where the document is placed for automatic feeding.

12 Claims, 21 Drawing Sheets

IMAGE FORMING APPARATUS FOR BLANKING PORTIONS OF A DOCUMENT

This is a continuation of application Ser. No. 885,710, filed July 15, 1986, which was abandoned upon the filing hereof.

BACKGROUND OF THE INVENTION

1. Field of the Invention

The present invention relates to an image forming apparatus. More specifically, the invention relates to a copying machine which blanks unwanted portions of a document specified by the user.

2. Description of the Prior Art

Generally, image forming apparatuses such as copying machines have functions for reduction or enlargement of document images, but in such apparatuses the images of documents are simply copied as they are. However, it would be desirable if a function for edited copying of documents in such an apparatus could be developed. More particularly, there is a strong demand for development of a function that would permit copying to be effected with blanking of unwanted portions of the document image.

One image forming apparatus has already been developed which fulfills this requirement (U.S. Pat. No. 4,215,929, Sato et al.). This existing image forming apparatus consists of a light source which applies an image area control light which controls the formation of the electrostatic latent image on a photosensitive body by cutting off or applying light in association with the exposure of the document image original, a mask member which controls the control light to a desired width by superposition, and a control means for controlling the working of this mask member. The aim here is to control the formation of the electrostatic latent image by the difference between the two operations, whereby the control light mentioned above is either transmitted or masked, and thus to obtain an image of the required area of the document image original. Depending on the way in which the mask member is superposed, either an image of a part of the document image original can be obtained, or the part can be erased and an image obtained of the remainder.

Further, this existing image forming apparatus is provided with a monitoring means which displays the document image original, and a position determining means, which in association with this monitoring means selects as desired that area of the document image original which is required. By controlling the mask member in association with the position determining means, the required area of the document image original can be selected at will as the document image original is displayed, and an image of that area may be obtained.

However, the existing image forming apparatus as disclosed in U.S. Pat. No. 4,215,929 has the following drawbacks:

(1) Mechanical parts, such as a motor and gears, are required to shift the mask member between the single and the superposed state, and this makes the apparatus complicated. Also, there is a strong possibility that in use over a long period the mask member will become deformed, making accurate masking impossible.

(2) The monitoring means consists of a lamp for irradiating the document, a mirror and lens for directing the light reflected from the document, and a screen on which the image of the document is projected. This monitoring means is provided separate from the document table which is provided, above the photosensitive body, for the exposure of the document. Space is therefore required for the provision of this monitoring means, and this increases the overall size of the image forming apparatus.

SUMMARY OF THE INVENTION

It is an object of the invention to provide an improved image forming apparatus which permits images to be formed by designation of portions of the document image for which an image is to be formed and permits blanking of unnecessary portions by a simple procedure without operation mistakes and which is extremely convenient for the purpose of document image editing.

According to one aspect of the present invention, there is provided an image forming apparatus comprising:

an image carrier;

a document table on which a document is placed;

a document feeder associated with the document table for feeding the document onto wherein the document table, the document feeder includes:

a document carrier for carrying the document, and designating means for designating an image blanking range of the document placed on the document carrier;

optical scanning means for optically scanning the document fed onto the document table from the document feeder and for forming a reflected light image thereof;

a first image forming means for forming an electrostatic latent image corresponding to the light image onto the image carrier;

second image forming means for producing a visible image on said image carrier corresponding to the electrostatic latent image;

image blanking means for blanking a selected portion, corresponding to the image blanking range designated by the designating means, of the electrostatic latent image formed by the first image forming means; and control means for controlling the image blanking means to erase the electrostatic latent image corresponding to the blanking range.

BRIEF DESCRIPTION OF THE DRAWINGS

FIGS. 1 through 25 show an embodiment of an image forming apparatus according to the present invention in which:

FIGS. 1 and 2 are a schematic perspective view and a side sectional view, respectively, showing the construction of the image forming apparatus;

FIG. 3 is a side sectional view showing the construction of an automatic document feeder;

FIG. 4 is a side sectional view showing the construction of a spot light source;

FIG. 5 is a perspective view of the principal part including a spot light source;

FIG. 6 is a plan view of a control panel provided on the automatic document feeder;

FIGS. 7 and 8 are a schematic perspective view and a plan view, respectively, illustrating the operation of the spot light source;

FIG. 9 is a side sectional view for explaining placement of a document on the automatic document feeder;

FIGS. 12 and 13 are side sectional views for explaining transport of the document in the automatic document feeder;

FIG. 14 is a plan view of a control panel provided on a copying machine main body;

FIG. 15 is a perspective view showing an arrangement of drive sections;

FIG. 16 is a perspective view schematically showing a drive mechanism for an optical system;

FIG. 17 is a perspective view schematically showing a drive mechanism for pointers;

FIG. 18 is a block diagram showing a general control circuit;

FIG. 19 is a block diagram showing a control circuit of the automatic document feeder;

FIG. 20 is a side sectional view of the principal part showing an arrangement of the blanking array;

FIGS. 21 and 22 are a perspective view and a front view, respectively, of only the principal part of the blanking array, showing the relationship between the blanking array and a photosensitive drum;

FIG. 24 is a circuit diagram illustrating the configuration of an array drive section; and FIG. 25 is a side sectional view of the principal part showing another arrangement of the blanking array.

DETAILED DESCRIPTION OF THE PREFERRED EMBODIMENT

The preferred embodiment of the present invention will be described with reference to the accompanying drawings.

Figure 1:
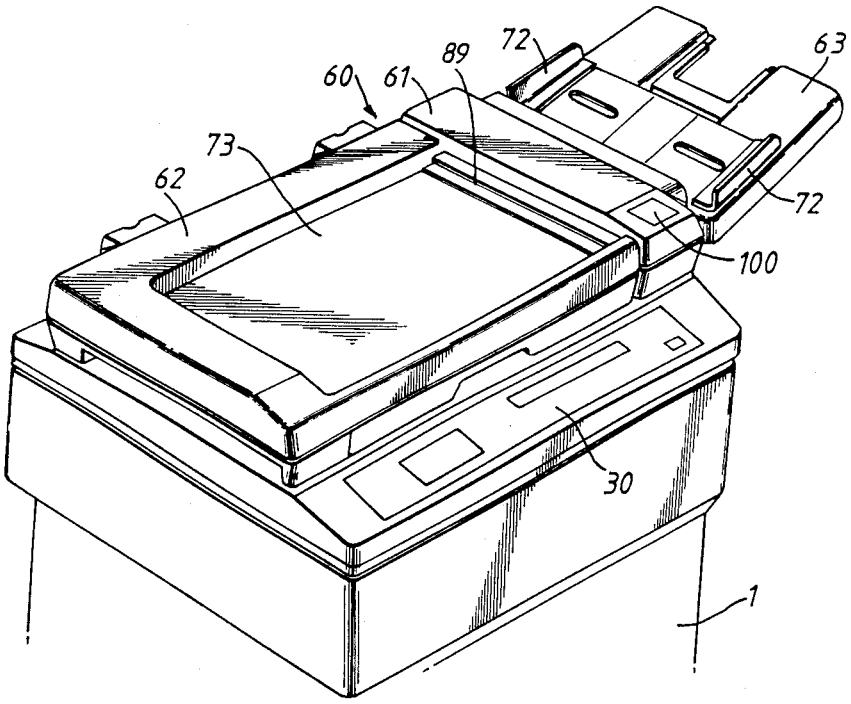
Figure 2:
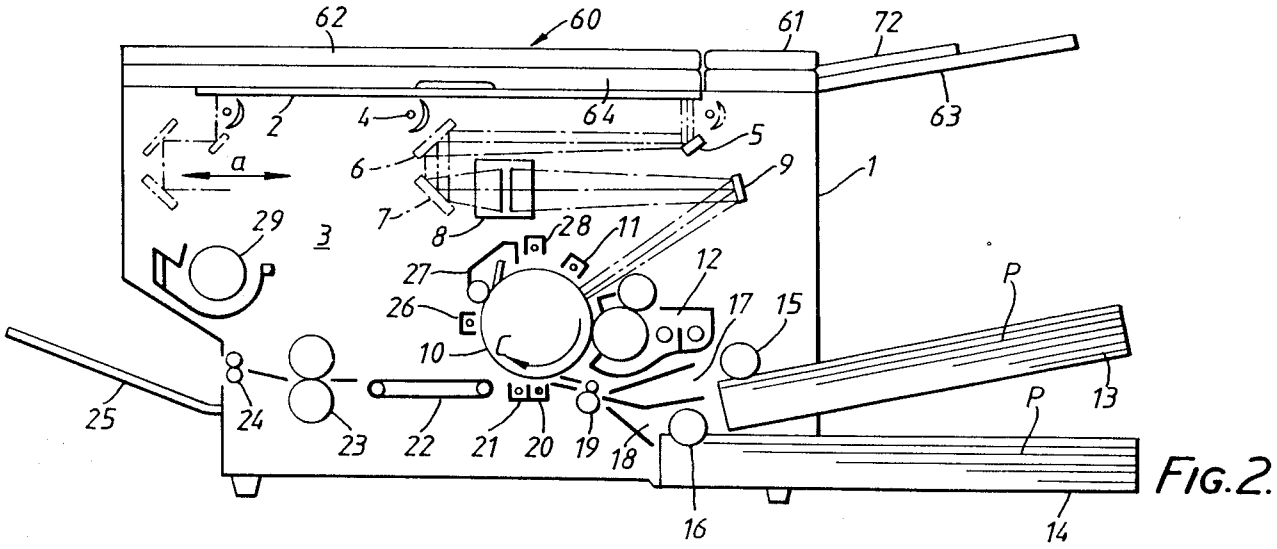

FIGS. 1 and 2 show schematic representations of a copying machine as an example of an image forming apparatus according to the present invention that is provided with an automatic document feeder. Numeral 1 designates a copying machine main body. On the upper surface of the main body 1, an automatic document feeder 60 is provided. Document feeder 60 effects automatic supply of documents. On the upper surface of main body 1, there is also a document table (i.e., a transparent glass plate) 2 constituting a support section on which documents forwarded by automatic document feeder 60 are set.

The document set on document table 2 is scanned for image exposure by an optical system 3 including an exposure lamp 4 and mirrors 5, 6 and 7 which reciprocate in the direction indicated by arrow a along the under surface of document table 2. In this case, mirrors 6 and 7 move at a speed half that of mirror 5 so as to maintain a fixed optical path length.

A reflected light beam from the document scanned by optical system 3, that is, irradiated by exposure lamp 4, is reflected by mirrors 5, 6 and 7, transmitted through a lens block 8 for magnification or reduction, and then reflected by a mirror 9 to be projected on a photosensitive drum 10. Thus, an image of the document is formed on the surface of photosensitive drum 10.

Photosensitive drum 10 rotates in the direction indicated by arrow c so that its surface is wholly charged first by a main charger 11. The image of the document is projected on the charged surface of photosensitive drum 10 by slit exposure, thereby forming an electrostatic latent image on the surface. The electrostatic latent image is developed into a visible image (toner image) by a developing unit 12 using toner.

A copy paper (an image forming medium) P is taken out one sheet at a time by a paper supply roller 15 or 16 from a selected upper paper supply cassette 13 or lower paper supply cassette 14 and is guided via a copy paper guide path 17 or 18 to a pair of aligning rollers 19 which guide it to a transfer section. Paper supply cassettes 13 and 14 are detachably mounted in a lower end portion of the right-hand side of main body 1, and the arrangement is such that either one of them can be selected from a control panel not shown. Copy paper P that has been forwarded to the transfer section is brought into close contact with the surface of photosensitive drum 10 in a transfer charger section 20 so as to transfer the toner image on photosensitive drum 10 through the action of charger 20. Having had the image transferred onto it, the copy paper P is electrostatically detached from photosensitive drum 10 by the action of a separation charger 21. Then copy paper P is carried by a transport belt 22 to heat rollers 23 which are located at the end of the transport belt 22 to constitute a fixing unit. The image is fixed by passage through this unit, and after fixing the copy paper P is delivered to a tray 25 outside main body 1 by a pair of feed-out rollers 24. Following transfer, photosensitive drum 10 has charge removed from it by a charge-removal charger 26, and residual toner is removed from its surface by a cleaner 27 before the residual image is erased by a discharge lamp 28, thereby bringing photosensitive drum 10 to its original state. Numeral 29 designates a cooling fan for preventing rise of temperature inside main body 1.

Figure 14:
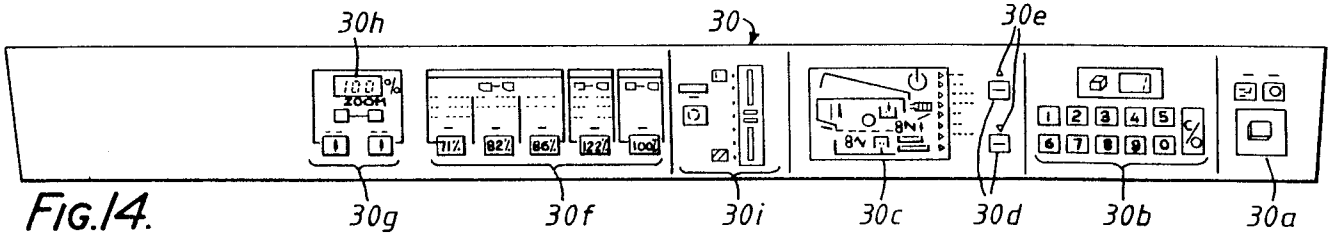

FIG. 14 shows a control panel 30 that is provided on a front edge portion of the upper surface of main body 1. Control panel 30 carries thereon a copy key 30*a* for starting the copying operation, number keys 30*b* for setting the number of copies to copiesto be made and the like, a display section 30*c* for indicating the various copy states and of copy paper jamming, cassette selection keys 30*d* for alternatively selecting upper paper supply cassette 13 or lower paper supply cassette 14, and a cassette display section 30*e* for indicating the selected cassette. Control panel 30 is further provided with magnification setting keys 30*f* for setting the enlargement or reduction ratio of copy selected among several predetermined ratios, zoom keys 30*g* for adjustably setting the enlargement or reduction ratio, a display section 30*h* for displaying the set ratio, and a density setting section 30*i* for setting the copy density.

Figure 15:
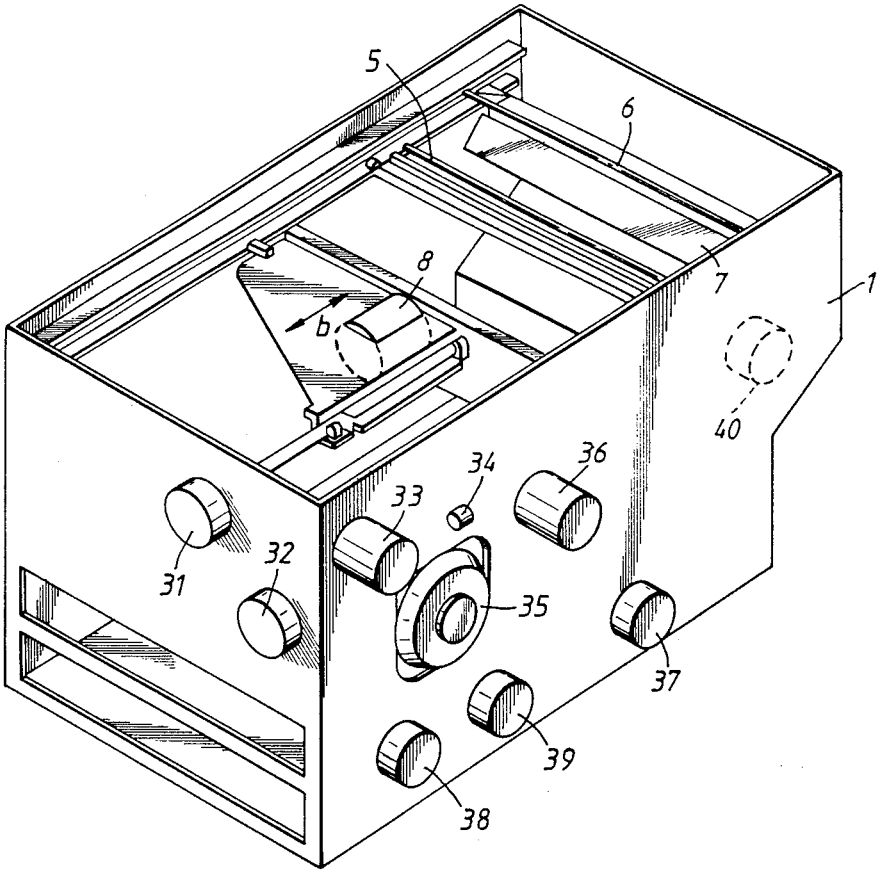

FIG. 15 shows an example of the drive source configuration of the various drive sections of a copying machine having a construction such as described above. The configuration consists of various motors as follows. A lens motor 31 serves to move lens block 8 so as to change the magnification. A mirror motor 32 serves to change the distance (optical path length) between mirror 5 and mirrors 6 and 7, so as to change the magnification. A scanning motor 33 causes movement of exposure lamp 4 and mirrors 5, 6 and 7 such as to effect scanning of the document. A shutter motor 34 causes movement of a shutter (not shown) in order to adjust the width over which charging of photosensitive drum 10 is effected by main charger 11 when the magnification is changed. A developing motor 35 serves to drive developing rollers and the like in developing unit 12. A drum motor 36 serves to drive photosensitive drum 10. A fixing motor 37 serves to drive transport belt 22, heat rollers 23 and feed-out rollers 24. A paper supply motor 38 serves to drive paper supply rollers 15 and 16. A paper feed motor 39 serves to drive aligning rollers 19, and a fan motor 40 serves to drive cooling fan 29.

Figure 16:
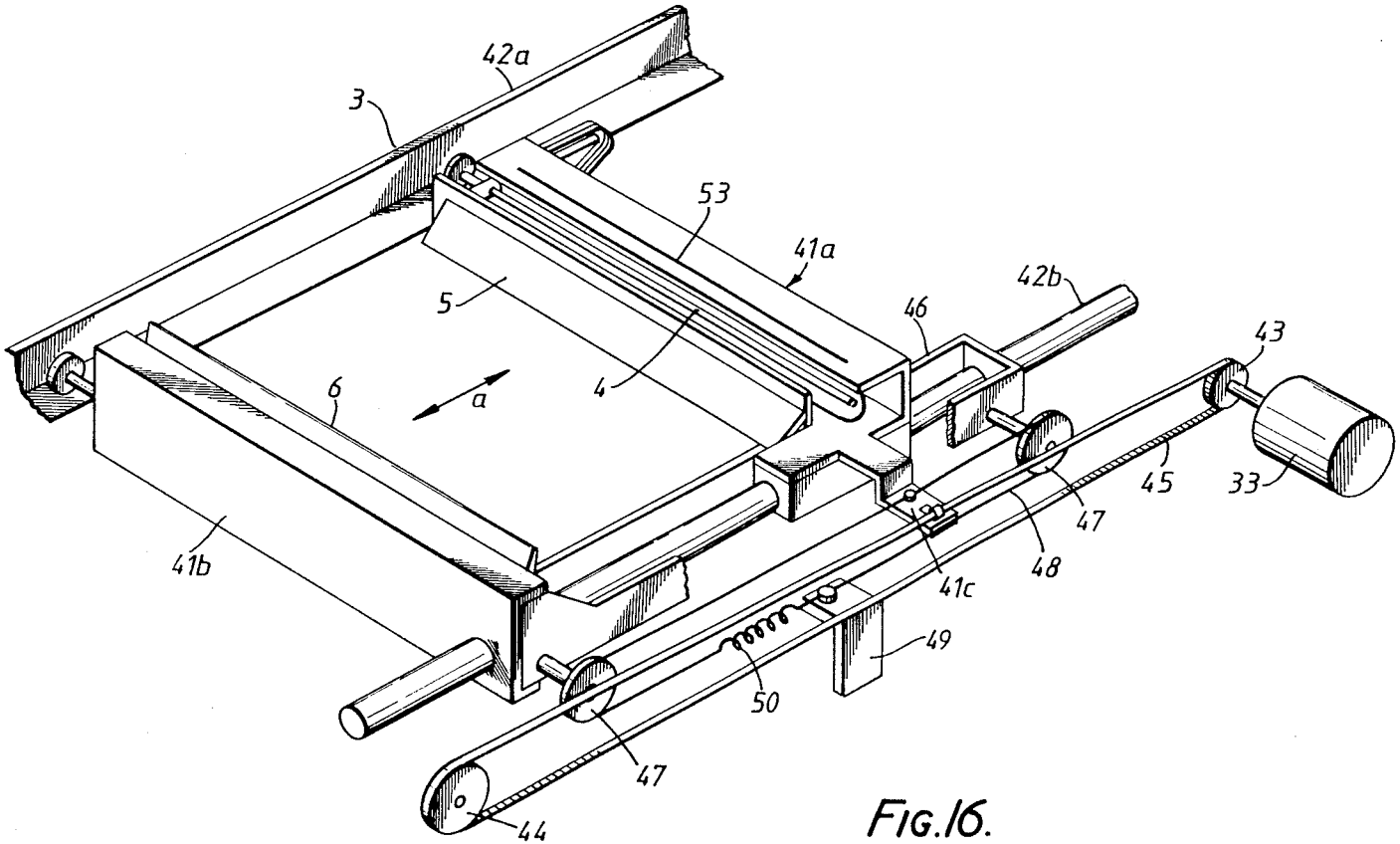

FIG. 16 shows the drive mechanism for causing reciprocal movement of optical system 3. Mirror 5 and exposure lamp 4 are supported by a first carriage 41*a*, mirrors 6 and 7 are supported by a second carriage 41*b*, and first and second carriages 41*a* and 41*b* move in parallel in the directions of arrow a, guided by guide rails 42*a* and 42*b*. In more detail, pulse motor 33, which is a four-phase motor, drives a pulley 43. An intermediate portion of an endless belt 45 that passes around and between pulley 43 and an idle pulley 44 is fixed to one end portion 41*c* of first carriage 41*a* supporting mirror 5. Two pulleys 47 and 47 that are located separately from one another on a line going in the direction of the axis of rail 42*b* are rotatably mounted in the guide section 46 of second carriage 41*b* supporting mirrors 6 and 7. A wire 48 passes around and between pulleys 47 and 47 and has one end fixed to a fixed element 49 and its other end fixed via a coil spring 50 to fixed element 49. An intermediate portion of wire 48 is fixed to the end of first carriage 41*a*. On rotation of pulse motor 33, therefore, belt 45 rotates and first carriage 41*a* is displaced, and this is accompanied by displacement of second carriage 41*b*. Since pulleys 47 and 47 act as fall blocks at this time, second carriage 41*b* moves in the same direction as first carriage 41*a* but at half the speed. The direction of movement of first and second carriages 41*a* and 41*b* is controlled by changing the direction of rotation of pulse motor 33.

An indication of the range over which copying is possible with the selected copy paper is given on document table 2. More specifically, if the size of copy paper selected by cassette selection keys 30*d* is designated as (Px, Py) and the copy magnification specified by magnification setting keys 30*f* and zoom keys 30*g* is designated as K, the possible copying range is (x, y), where $x=Px/K$ and $y=Py/K$. The x direction in this possible copying range if indicated by pointers 51 and 52 that are located at the rear surface of document table 2 as shown in FIG. 17, while the y direction is indicated by a scale 53 that is provided on the upper surface of a first carriage 41*a*.

Figure 17:
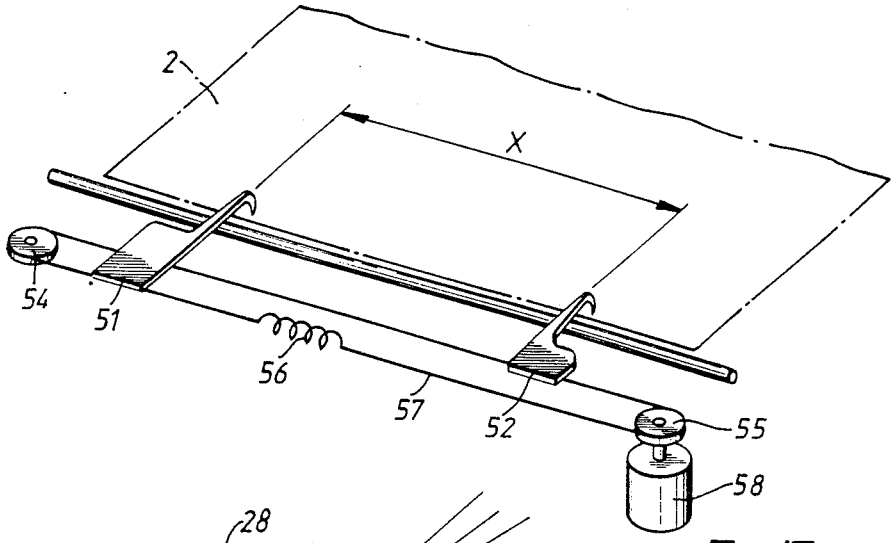

As shown in FIG. 17, pointers 51 and 52 are mounted on a wire 57 with an intermediate spring 56 that passes around and between pulleys 54 and 55. Pulleys 54 and 55 are rotated by a motor 58 which is driven so that its rotation corresponds to the copy paper size and the magnification to cause changes in the distance between pointers 51 and 52.

Motor 33 is driven in accordance with the copy paper size and the magnification, and as a result of this drive first carriage 41*a* is moved to a set position (a "home position" which depends on the magnification). When, now, copy key 30*a* is depressed, first carriage 41*a* first moves towards second carriage 41*b*, and then after this lamp 4 is lit and, first carriage 41*a* is moved in a direction in which it moves away from second carriage 41*b*. When scanning of the document is completed, lamp 4 is turned off and first carriage 41*a* is returned to its initial home position.

Figure 3:
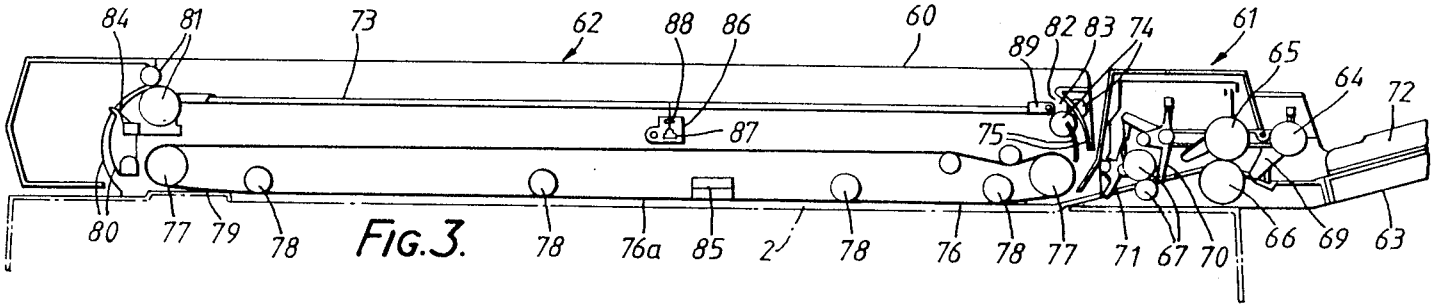

Referring to FIGS. 1, 2 and 3, an automatic document feeder 60 is shown which comprises a supply section 61 which supplies documents and a transport section 62 for transport of documents. Supply section 61 consists of a document supply tray 63 on which documents are set, a supply roller 64 for effecting supply of original documents that have been set on supply tray 63, a forwarding roller 65, a separating roller 66 and a pair of aligning rollers 67. A detector 69 which detects when there are no documents on document supply tray 63 is provided near forwarding roller 65, and a detector 70 for detecting document supply faults is provided between forwarding roller 65 and aligning rollers 67. A detector 71 which detects the size of documents that have been supplied in is provided near aligning rollers 67. Detectors 69, 70 and 71 are constituted by elements such as detection levers and microswitches, for example. On document supply tray 63, guides 72 and 72 are provided the width of guides 72 and 72 being adjustable to correspond to the width of documents inserted to supply section 61.

Transport section 62 consists of a document carrier 73 that is constituted by transparent glass on which documents that are to be subjected to trimming (blanking) are placed such that the image surface faces upward, a pair of take-in rollers 74 and 74 which take in the documents from document carrier 73, a guide 75 by which the document that has been taken in by the pair of take-in rollers 74 and 74 is guided downwards, and an endless belt 76 constituting a transport means for transport of documents that have been guided along by guide 75 or have been supplied from supply section 61. Transport section 62 further consists of rollers 77 around which endless belt 76 is passed, rollers 78, 78, 78 and 78 which press endless belt 76 onto document table 2, a stopper 79 constituting a document stopping means by which the document that has been fed onto document table 2 is temporarily stopped and held, a guide plate 80 by which the document that has been carried to the end of belt 76 is guided upwards and a pair of feed-out rollers 81 and 81 by which the document led up by guide plate 80 is fed out onto document carrier 73.

A transport path 76*a* is defined by belt 76 and original document table 2. Near the pair of take-in rollers 74 and 74, there is a detector 83 which detects when a document has been inserted into a document insertion port 82 from document carrier 73. Further, near feed-out rollers 81, there is a detector 84 which detects faults in the transport of the document being fed out. Detectors 83 and 84 are constituted by elements such as detection levers and microswitches, for example. A detector 85 for optical detection of whether transport section 62 is open or closed is provided in transport section 62. At an end portion of document carrier 73, going in the direction of its short side, there is a fixed scale 89 which constitutes a reference marker for setting the document in place.

Figure 4:
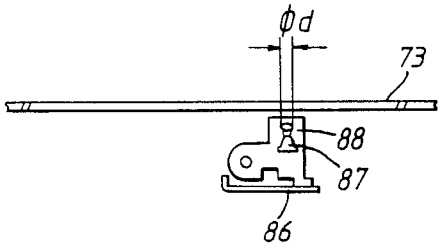

Below document carrier 73, there is provided a spot light source 86 as shown in FIG. 4, which faces document carrier 73 and consists, for example, of a light-emitting element 87 such as a light-emitting diode or lamp and a lens 88. The light emitted by light-emitting element 87 is directed as a light spot with a diameter $\phi d$ onto document carrier 73. This light spot is sufficiently bright for it to pass through a document about as thick as a postcard that is set on document carrier 73.

Figure 5:
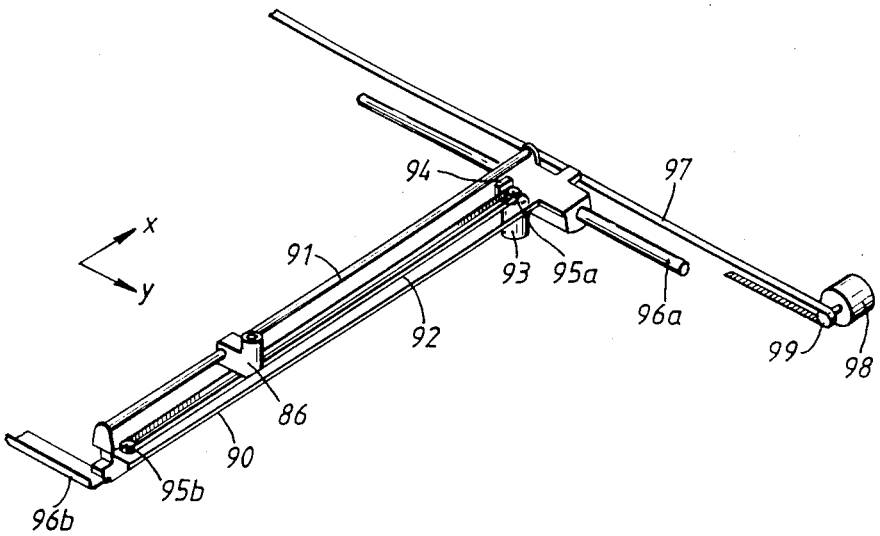

A drive mechanism such as shown in FIG. 5 moves spot light source 86 in the x direction and y direction. In this mechanism, spot light source 86 is supported on a guide shaft 91 provided on a carriage 90 and is connected to a timing belt (toothed belt) 92 that is disposed parallel to guide shaft 91. This timing belt 92 passes round a pulley 95*a* provided on the rotation shaft of a pulse motor 93 and around a follower pulley 95*b*. When pulse motor 93 rotates, spot light source 86 is moved in the x direction as shown.

Carriage 90 is guided on a guide rail 96a and a guide 96b and can move parallel to the y direction indicated by the arrow. A timing belt (toothed belt) 97 which passes around a pulley 99 provided on the rotation shaft of a pulse motor 98 and a follower pulley (not shown) are connected to carriage 90. The arrangement is moved in the y direction as shown on rotation of pulse motor 98. A position sensor 94 in the form of a microswitch for detection of an initial position for spot light source 86 is provided on carriage 90 at the pulse motor 93 end of guide shaft 91. This arrangement being, for example, such that when spot light source 86 is moved, it is first brought into contact with position sensor 94, thereby permitting detection of its initial position.

Figure 6:
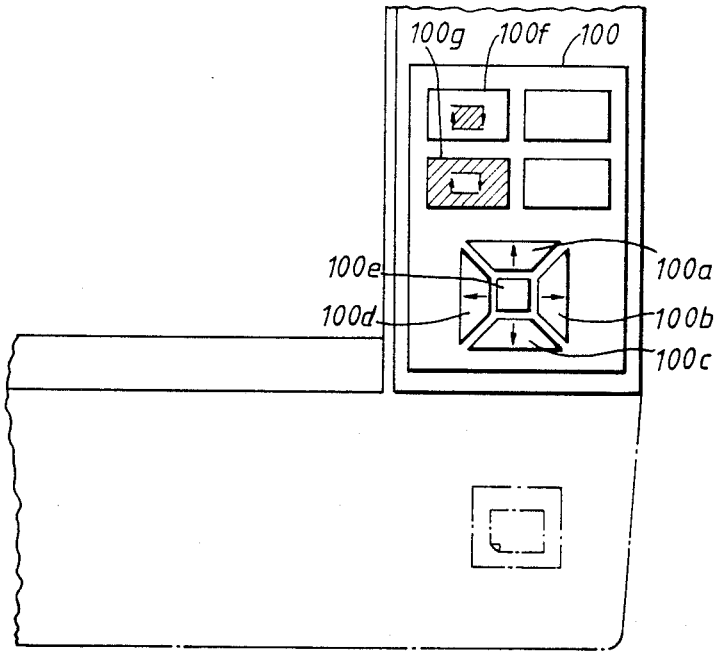

Referring to FIG. 6, a control panel 100 for effecting blanking operations is provided on top of supply section 61. Numerals 100a, 100b, 100c and 100d designate operation keys for moving spot light source 86, numeral 100e designates a position designation key for inputting coordinate positions represented by spot light source 86 and numerals 100f and 100g designate keys for specifying blanking ranges that are at designated positions.

Figure 18:
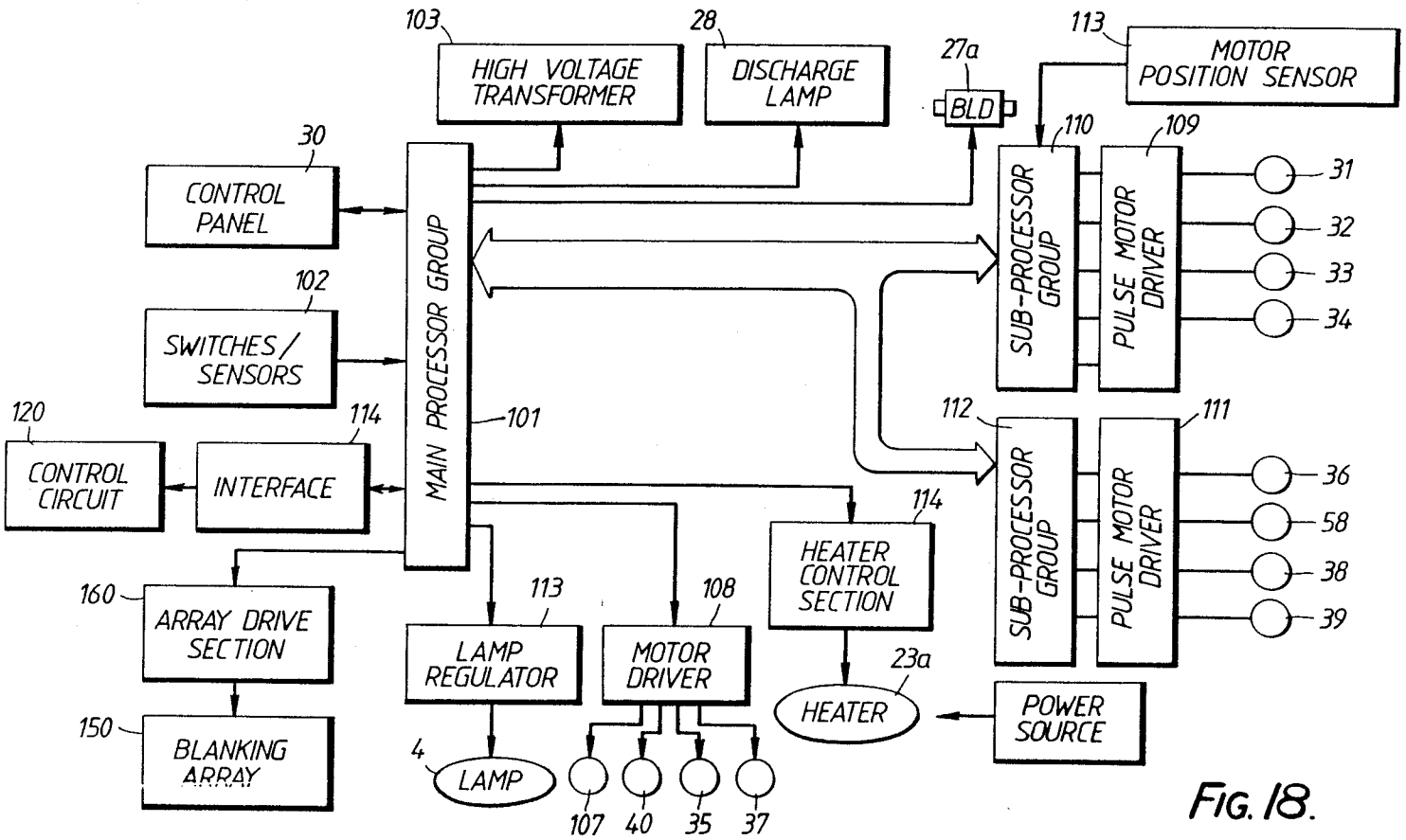

FIG. 18 shows the overall control circuit. First, the control circuit of copying machine main body 1 will be described. A main processor group 101 detects input from control panel 30 and various input devices 102 such as switches and sensors, etc. and controls a high voltage transformer 103 which drives the various chargers, discharge lamp 28, a blade solenoid 27a of cleaner 27, a heater 23a of fixing rollers 23 and motors 31–40, 58 and 107 in order to effect copying operations. It also effects operations for blanking of unrequired portions of the document by controlling elements such as a blanking array 150, an array drive section 160 and a memory 106 (not shown) which will be described later.

Motors 35, 37 and 40 among motors 31–40 and 58 and a toner motor 107 for supplying toner to developing unit 12 are controlled by main processor group 101 via a motor driver 108. Motors 31–34 are controlled by a first subprocessor group 110 via a pulse motor driver 109. Further, motors 36, 38, 39 and 58 are controlled by a second subprocessor group 112 via a pulse motor driver 111. Exposure lamp 4 is controlled by main processor group 101 via a lamp regulator 113, heater 23a is controlled by a heater control section 114 and signals indicating the state of heater 23a are supplied to main processor group 101. Commands for driving or stopping the various motors are supplied to first and second subprocessor groups 110 and 112 from main processor group 101, and first and second subprocessor groups 110 and 112 supply main processor group 101 with information indicative of the motor drive and stop states. Main processor group 101 also receives input of position information from position sensors 133 which detect the initial positions of motors 31–34.

Figure 7:
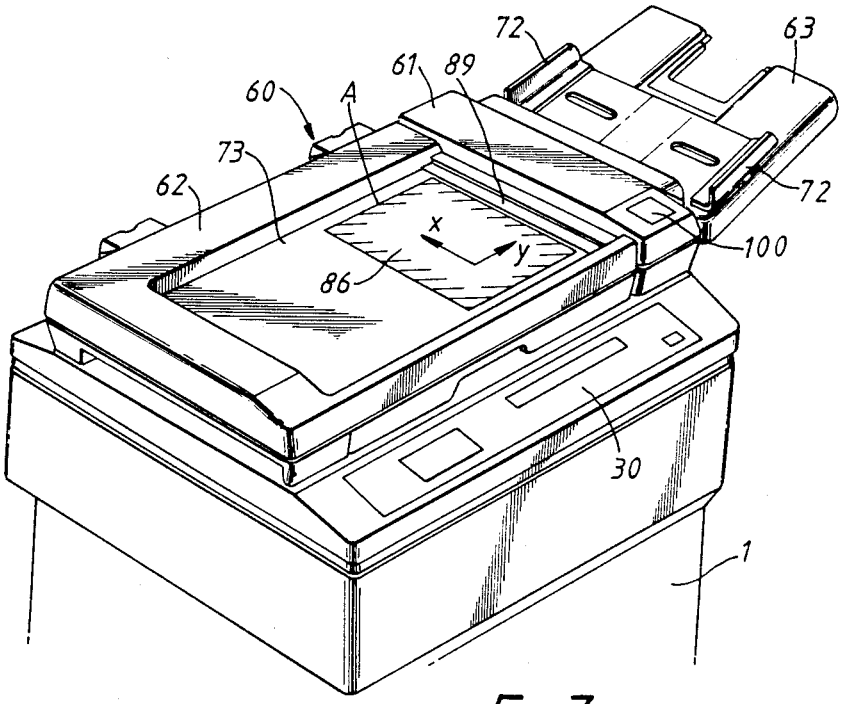
Figure 8:
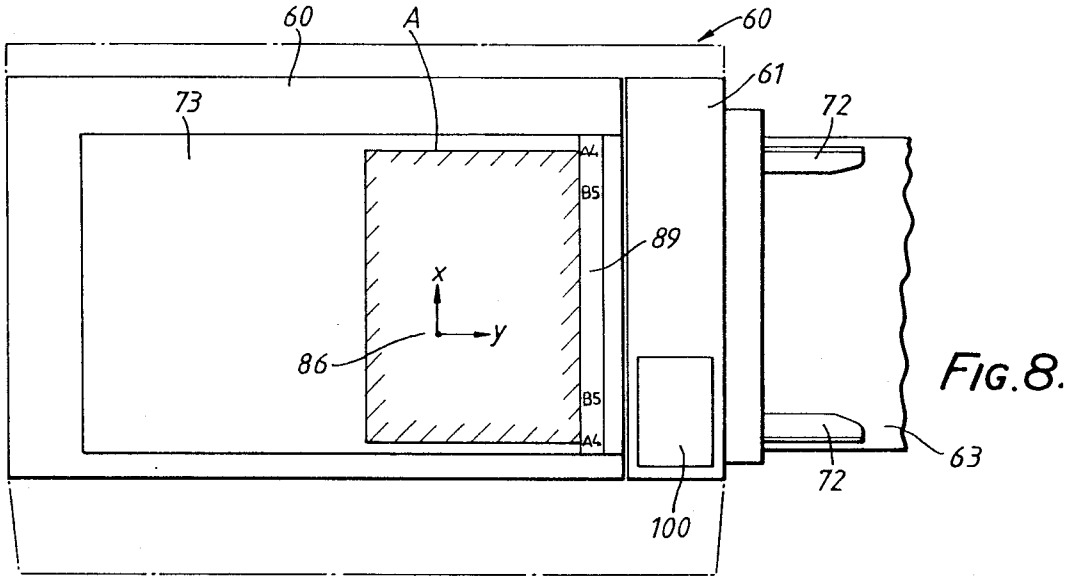
Figure 19:
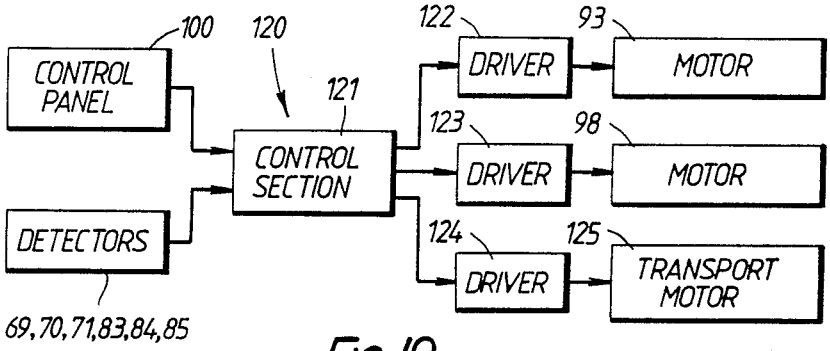

A control circuit 120 of automatic document feeder 60 is connected to main processor group 101 via an interface 113. Control circuit 120 has a configuration such as shown in FIG. 19. Numeral 121 designates a control section for overall control of document feeder 60. Control section 121 determines when the blanking mode is operative and what the blanking range is on the basis of signals from control panel 100 and outputs blanking mode signals and signals indicating the blanking range to main processor 101. During blanking mode, control section 121 actuates drivers 122 and 123 in response to signals from operation keys 100a–100d to cause rotation of motors 93 and 98 and move spot light source 86 in the x direction and y direction as shown in FIGS. 5, 7 and 8. Control section 121 also causes rotation of a transport motor 125 to cause rotation of rollers 64–67, 74, 77, 78 and 81 noted above by actuating a driver 124 in response to signals from detectors 69, 70, 71, 83, 84 and 85.

There now follows a description of the method for designating a blanking range by means of spot light source 86. Actuation of operation keys 100a–100d results in spot light source 86 being moved with light-emitting element 87 lit. That is, when operation key 100b or 100d is pressed, motor 98 is actuated and spot light source 86 is moved in the y direction. While if operation key 100a or 100c is pressed, motor 93 is actuated and spot light source 86 is moved in the x direction.

Figure 10A:
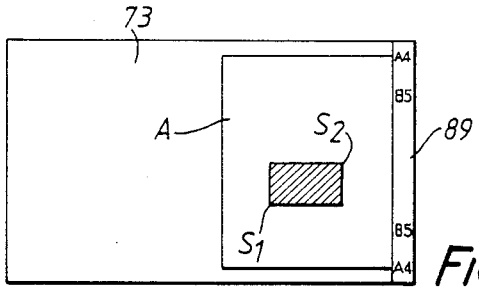
FIGS. 10A and 10B are plan views illustrating an operation for designating the blanking range of the document.

The operator actuates operation keys 100a–100d while observing the light spot that has passed through document A placed on document carrier 73 such that the image surface faces upward, and when, for example, the light spot has been moved to a point S1 on document A as shown in FIG. 10A, the operator presses position designation key 100e. Doing this results in the coordinate position data represented by S1 being stored in an internal memory (not shown) in control section 121. Similarly, pressing position designation key 100e when the light spot has been moved to a point S2 on document A results in the position of point S2 being stored in the internal memory in control section 121. The position of the light spot can be detected by, for example, counting the numbers of pulse motor 98 and 93 drive pulses.

When, subsequently, the blanking range specification key 100f is pressed, a rectangular area with points S1 and S2 at diagonally opposite corners as shown in FIG. 10A (shown shaded) is designated as the blanking range. Alternatively, if a point S3 and a point S4 on document A are specified and blanking range designation key 100g is pressed, the portion that is outside the square that has points S3 and S4 at diagonally opposite corners is designated as the blanking range. When blanking range designation key 100f or 100g is thus pressed, the position data of two specified points are input to main processor group 101 by control section 121 via interface 114. In response, main processor group 101 carries out computations on the basis of the position data of the two specified points and the copy magnification ratio and high level signals "1" are stored in memory 106 for the blanking range portion and low level signals "0" are stored for portions other than the blanking range portion.

Figure 10B:
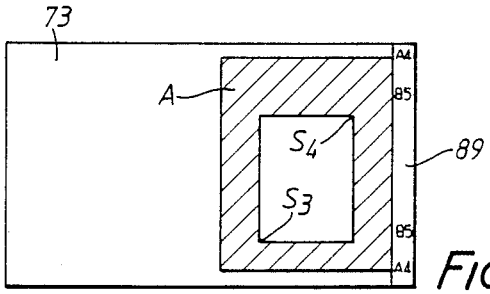
Figure 11A:
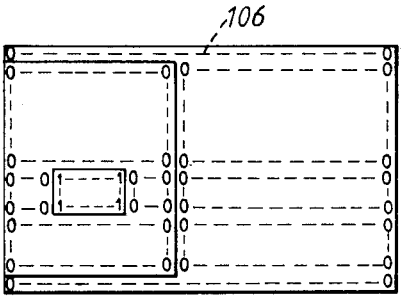
FIGS. 11A and 11B are plan views for explaining memory contents.
Figure 11B:
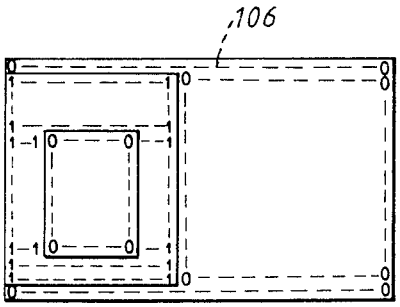

A rank capacity of memory 106 substantially corresponds to a value given by (moving distance of spot light source 86 along the x direction)÷(position resolution along the x direction). A line capacity of memory 106 substantially corresponds to a value given by (moving distance of spot light source 86 along the y direction)÷(position resolution thereof along the y direction). Memory 106 comprises a RAM having the memory capacity described above. In the cases of FIGS. 10A and 10B, high level signals are stored at addresses corresponding to the hatched area and low level signals are stored at other addresses in response to the data supplied from main prosessor group 101, as shown in FIGS. 11A and 11B, respectively.

Figure 20:
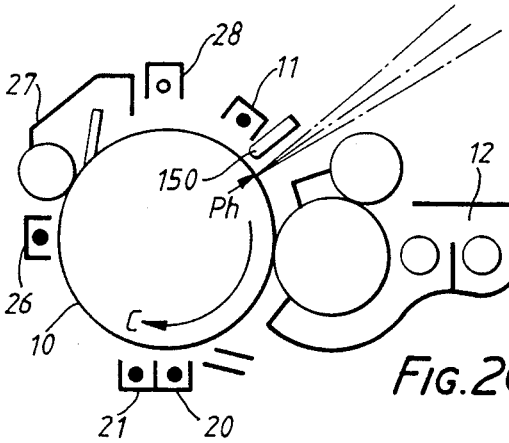
Figure 21:
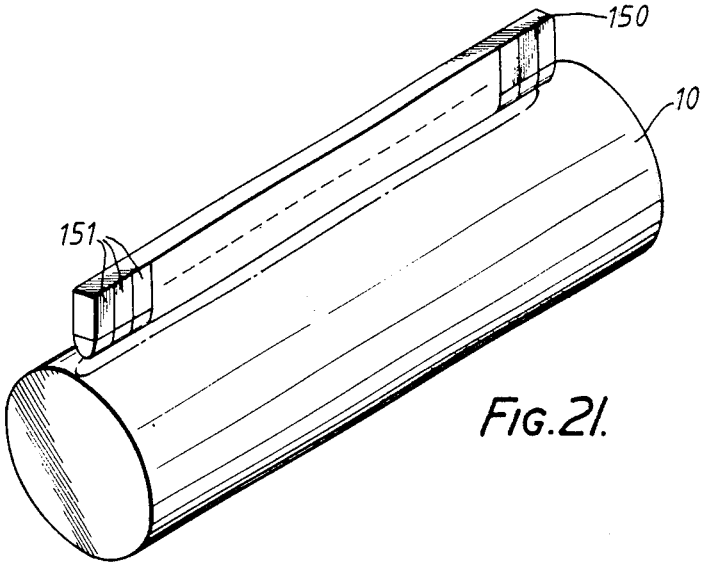
Figure 22:
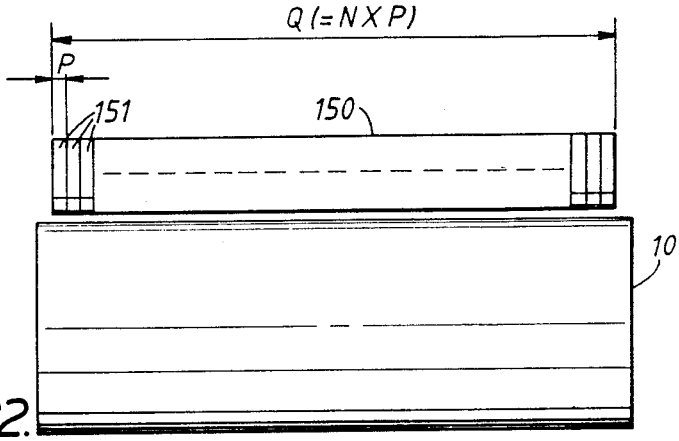
Figure 23A:
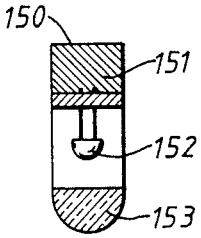
FIG. 23A is a side sectional view of the blanking array.
Figure 23B:
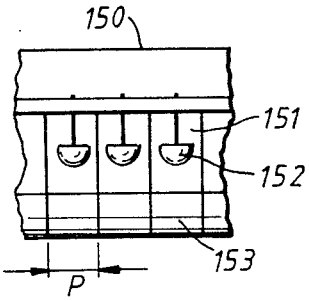
FIG. 23B is a partial front view of the blanking array.

As shown in FIG. 20, on the other hand, a blanking array 150 as the blanking means is disposed close to photosensitive drum 10, between main charger 11 and an exposure region Ph, for example. As shown in FIGS. 21 and 22, blanking array 150 includes a plurality of shading cells 151 arranged in a direction perpendicular to the rotating direction of photosensitive drum 10. As shown in FIGS. 23A and 23B, shading cells 151 each contain a light emitting element 152 formed of, e.g., a light emitting diode. Moreover, a lens 153 for converging light from light emitting element 152 on the surface of photosensitive drum 10 at the opening portion of each cell 151 facing photosensitive drum 10. The number of light emitting elements arranged in blanking array 150 is, for example, equal to the number of degrees of resolution corresponding to moving distances of spot light source 86 along the x direction. If the number of light emitting elements 152 is N and the distance between them is P, the overall length Q of blanking array 150 is given by $Q=N\times P$.

Figure 24:
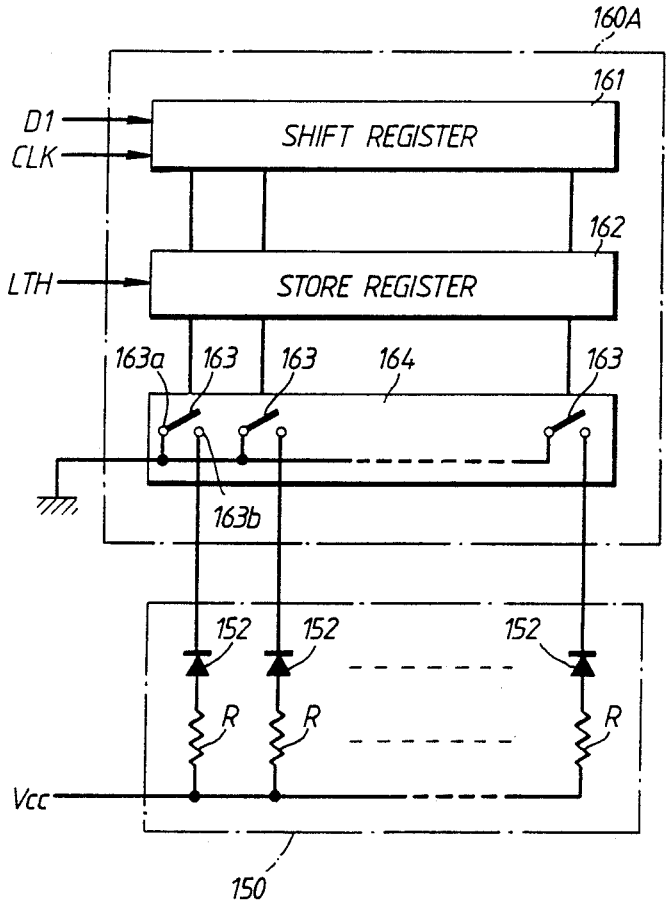

Blanking array 150 is driven by drive section 160A. As shown in FIG. 24, drive section 160A comprises a shift register 161 having the same bit number as the rank bit number of memory 106, a store register 162 for storing the contents of shift register 161, and a switching circuit 164 consisting of a plurality of switch elements 163 which are turned on/off in response to output signals from store register 162. Movable contacts 163*a* of elements 163 are grounded, and stationary contacts 163*b* thereof are respectively connected to the cathodes of light emitting elements 152 constituting blanking array 150. The anodes of light emitting elements 152 are connected to a power source Vcc through current limiting resistors R.

After designating the document blanking range in the manner described above, the operator inserts document A into document insertion port 82, and this insertion is detected by detector 83 so that the opertor now may actuate copy key 30*a*. Hereupon, document A is taken in by take-in rollers 74 and is transported along guide 75 and transport path 76*a* to be brought onto document table 2, following which first carriage 41*a* and photosensitive drum 10 are actuated and data for one rank is read out from memory 106 in the line direction (shown in FIG. 11). The data D1 that has been read out is transferred to shift register 161 of array drive section 160 in response to clock signals CLK.

Following transfer of data for one rank into shift register 161, when a charged portion of photosensitive drum 10 reaches blanking array 150, a latch signal LTH is output from main processor group 101, and in response the data stored in shift register 161 is supplied to store register 162. Since blanking array 150 is located between main charger 11 and exposure region Ph, the output timing of latch signal LTH is controlled such that the one rank data is transferred from memory 106 to store register 162 prior to $\theta 1/\omega$, where $\theta 1$ is the angle between array 150 and exposure region Ph and $\omega$ is the peripheral velocity of drum 10.

Switch elements 163 in switch circuit 164 are controlled in response to the output signals from store register 162. When the output of register 162 is set at high level, elements 163 are turned on. When the output of register 162 is set at low level, elements 163 are turned off. Light emitting elements 152 connected to switch elements 163 are turned on when their respective switch elements 163 are turned on and turned off when they are turned off. A charged drum portion corresponding to the ON elements 152 is discharged, and the remaining portion is not discharged, so that a latent image is not formed in the discharged portion even if the surface of drum 10 is exposed with light. In this manner, the unnecessary portion for one rank is erased. The data is thus read out from memory 106 in units of ranks, thereby blanking the unnecessary image portion.

Figure 9:
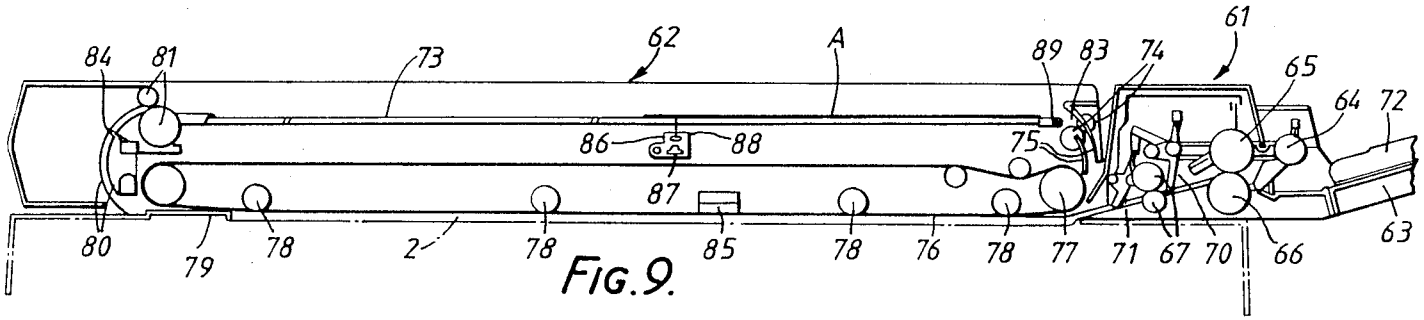

Next, the operation in a structure such as this will be described. First, the case in which copying is effected with blanking of a set portion of the document will be described. For example, the operator sets document A on document carrier 76 of automatic document feeder 60 so that its top side can be viewed (with its top side uppermost) as shown in FIGS. 7 and 8 and so that it is set against fixed scale 89 as shown in FIG. 9. Next, the operator actuates operation keys 100*a*–100*d* while observing the light spot that has passed through document carrier 76 and document A and presses position designation key 100*e* when the light spot has been moved to point S1 on document A as shown in FIG. 10A, for example. Doing this results in the coordinate position data represented by S1 being stored in the internal memory (not shown) in control section 121. Similarly, pressing position designation key 100*e* when the light spot has been moved to point S2 on document A results in the position data of point S2 being stored in the internal memory in control section 121.

When, subsequently, the blanking range specification key 100*f* is pressed, a rectangular area with points S1 and S2 at diagonally opposite corners as shown in FIG. 10A (shown shaded) is designated as the blanking range, and the position data of the two specified points are supplied as the blanking range from control section 121 to main processor group 101 through interface 134. In response, main processor group 101 carries out computations on the basis of the position data of the two specified points, and the copy magnification ratio and high level signals "1" are stored in memory 106 for the blanking range portion and low level signals "0" are stored for portions other than the blanking range portion. That is, high level "1" signals are stored in addresses in memory 106 which correspond to the blanking range and low level signals "0" are stored in other addresses, as shown in FIG. 11A.

Figure 12:
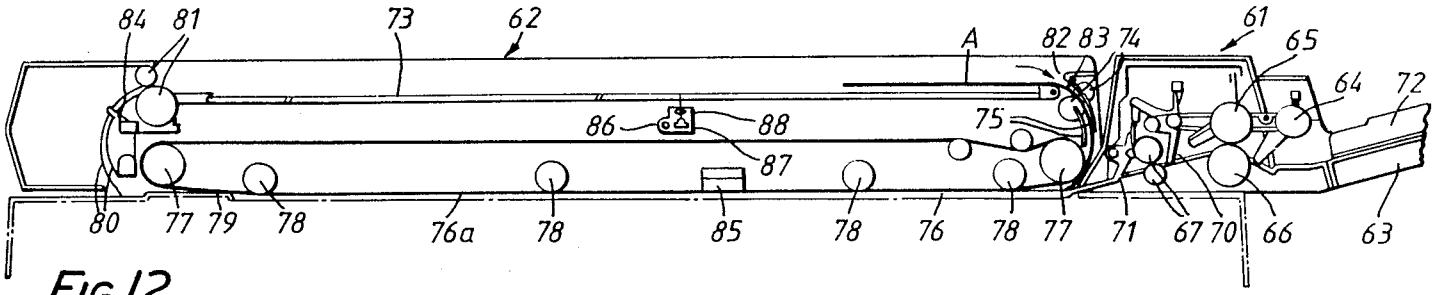
Figure 13:
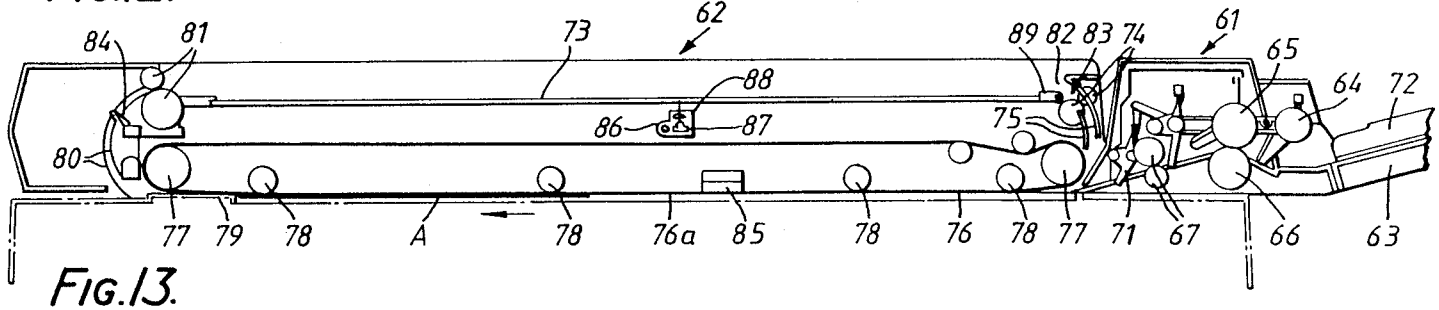

Next, the operator inserts the right-hand edge of document A into document insertion port 82 as shown in FIG. 12 and presses copy key 30*a*. Hereupon, main processor group 101 actuates take-in rollers 74 and transport belt 76 again. As a result, document A is transported along transport guide 75 and transport path 76*a* by take-in rollers 74 and transport belt 76. Then, on elapse of a given time, main processor group 101 stops transport belt 76 and the leading edge (left-hand edge) of document A is stopped by stopper 79 as shown in FIG. 13.

After document A has thus been brought onto document table 2, first carriage 41*a* and photosensitive drum 10 are actuated and data for one rank is read out from memory 106 in the line direction (shown in FIGS. 11A and 11B). The data D1 that has been read out is transferred to shift register 161 of array drive section 160 in response to clock signals CLK. Following transfer of data for one rank into shift register 161, when a charged portion of photosensitive drum 10 reaches blanking array 150, a latch signal LTH is output from main processor group 101 and in response the data stored in shift register 161 is supplied to store register 162. Switch elements 163 of switch circuit 164 are controlled by the output signals from store register 162. That is, switch elements 163 are turned on when store register 162 outputs high level signal. Similarly, switch elements 163 are turned off when store register 162 outputs low level signal. As a result, light emitting elements 152 are lit by turning on switch elements 163, while light emitting elements 152 are turned off by turning off switch elements 163.

Charge is removed from those charged portions of photosensitive drum 10 for which light emitting elements 152 are lit, thus effecting blanking of the document image, since no electrostatic latent image is formed on the portions from which charge has been removed, even though they are exposed afterwards. Subsequently, copying proceeds with image blanking effected by similar read out of data from memory 106 one rank at a time. After completion of copying, main processor group 101 actuates to draw back stopper 79, further, main processor group 101 actuates transport belt 76 and feed-out rollers 81, so causing document A to be fed out onto document carrier 76 by guide 80 and feed-out rollers 81.

If the operator places document A on document supply tray 63 and presses copy key 30*a*, main processor group 101 detects that it is ordinary copying, transports document A one at time onto document table 2 by means of supply unit 61 and effects ordinary copying.

As described above, a blanking range in the image of a document is specified by means of a spot light source provided in an automatic document feeder, and blanking of the specified range is effected by lighting of light emitting elements that are arranged facing a photosensitive drum. It is thus possible to effect copying with blanking of document images as required, which is extremely convenient for the purposes of editing documents, etc. Also, the operation is simple and there is no possibility of incorrect blanking, since there is no need to turn a document upside down at the time of blanking or start of the actual copying.

The operation is simple since specifying a blanking range simply involves moving a spot light source in correspondence to the blanking range of a document and there is also the advantage that since the blanking range is specified on the document this range does not become displaced.

Figure 25:
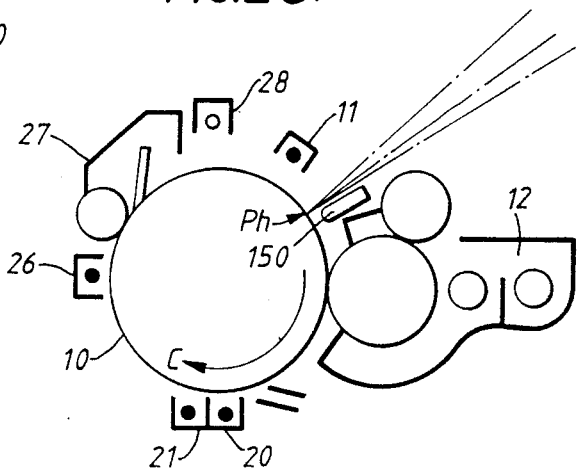

Although the blanking array was located between the main charger and the exposure region in the above embodiment, the invention is not limited to this but may be similarly practiced with a configuration in which the blanking array is located between the exposure region and the developing unit as shown in FIG. 25, and designated blanking is effected on an electrostatic latent image that has been formed.

Also, the invention is not limited to an electrostatic copying machine but may also be employed for a heat-sensitive copying machine or a thermal transfer copying machine, etc.

What is claimed is:

1. An image forming apparatus having an image carrier, comprising:

first means for receiving a document with a document image surface turned upward;

means for selectively designating an image forming range of said document placed with a document image surface turned upward on said first means, said designating means including a spot light source movable in a two-dimensional plane located along said document for emitting light through said document placed with the document image surface turned upward on said first means so as to define said image forming range;

second means for holding said document with the document image surface turned downward;

mechanical means for automatically transporting said document from said first means to said second means such that said document image surface is turned downward on said second means, and further transporting said document from said second means such that said document image surface is turned upward on said first means; and means for forming an image, corresponding to said image forming range of the image of said document placed with a document image surface turned downward on said second means, onto said image carrier.

2. An apparatus according to claim 1, wherein said first means includes a transparent glass.

3. An apparatus according to claim 2, wherein said designating means includes moving means operatively connected to said spot light source for moving said spot light source to corners of said image forming range, in response to manually entered commands.

4. An apparatus according to claim 1, wherein said image forming means includes:

optical scanning means for optically scanning said document moved onto said second means by said mechanical transporting means and for forming a reflected light image thereof;

means for forming an electrostatic latent image corresponding to said light image onto said image carrier;

means for forming a visible image on said image carrier corresponding to said electrostatic latent image;

image blanking means for blanking a selected portion, corresponding to a portion except for said image forming range designated by said designating means, of said electrostatic latent image formed by said electrostatic latent image forming means; and control means for controlling said image blanking means to erase the electrostatic latent image corresponding to said selected portion.

5. An apparatus according to claim 4, wherein said image carrier comprises a photosensitive drum rotatively provided and said image forming means further includes a plurality of light emitting elements which are opposed to said photosensitive drum and which are arranged in a direction perpendicular to the rotating direction of said photosensitive drum.

6. An apparatus according to claim 5, wherein said electrostatic latent image forming means includes charging means disposed close to said photosensitive drum for wholly charging the surface of said photosensitive drum, and said visible image forming means includes developing means disposed close to said photosensitive drum for developing the electrostatic latent image into a visible image using toner.

7. An image forming apparatus comprising:

an image carrier;

a document table on which a document is placed;

a document feeder associated with said document table for feeding said document onto said document table, wherein said document feeder includes:

a document carrier for carrying said document with a document image surface turned upward, an endless belt provided below said document carrier for transporting said document from said document carrier onto said document table such that said document image surface is turned downward on said document table, and further transporting said document from said document table ontoo said document carrier such that said document image surface is turned upward on said document carrier, and designating means for designating an image blanking range of said document placed with the document image surface turned upward on said document carrier, said designating means including a spot light source provided between said document carrier and said endless belt so as to be moved in a first direction and second direction perpendicular to said first direction for emitting light through said document placed on said document carrier, with the document image surface turned upward, and a moving means operatively connected to said spot light source for moving said spot light source to corners of said blanking range;

optical scanning means for optically scanning said document fed onto said document table, with the document image surface turned downward, from said document feeder and for forming a reflected light image thereof;

first image forming means for forming an electrostatic latent image corresponding to said light image onto said image carrier;

second image forming means for producing a visible image on said image carrier corresponding to said electrostatic latent image;

image blanking means for blanking a selected portion, corresponding to said image blanking range designated by said designating means, of said electrostatic latent image formed by said first image forming means; and control means for controlling said image blanking means to erase the electrostatic latent image corresponding to said blanking range.

8. An apparatus according to claim 7, wherein said document carrier is constituted by a transparent glass.

9. An apparatus according to claim 7, wherein said image carrier comprises a photosensitive drum rotatively provided and said image blanking means includes a plurality of light emitting elements which are opposed to said photosensitive drum and which are arranged in a direction perpendicular to the rotating direction of said photosensitive drum.

10. An apparatus according to claim 9, wherein said first image forming means includes charging means disposed close to said photosensitive drum for wholly charging the surface of said photosensitive drum, and said second image forming means includes developing means disposed close to said photosensitive drum for developing the electrostatic latent image into a visible image using toner.

11. An apparatus according to claim 10, wherein said light emitting elements are disposed between said charging means and an exposure region on which is irradiated said light image by said optical scanning means.

12. An apparatus according to claim 10, wherein said light emitting elements are disposed between an exposure region, on which is irradiated said light image by said optical scanning means, and said developing means.

* * * * *